US005305059A

United States Patent [19]

Kurosawa

[11] Patent Number: 5,305,059

[45] Date of Patent: Apr. 19, 1994

[54] IMAGE FORMING APPARATUS

[75] Inventor: Norio Kurosawa, Tokyo, Japan

[73] Assignee: Kabushiki Kaisha Toshiba, Kawasaki, Japan

[21] Appl. No.: 960,479

[22] Filed: Oct. 9, 1992

[30] Foreign Application Priority Data

Oct. 17, 1991 [JP] Japan ..... 3-269515

[51] Int. Cl.[5] ..... G03G 21/00

[52] U.S. Cl. ..... 355/208; 355/203; 355/204; 355/228; 355/69; 355/246

[58] Field of Search ..... 355/203-204, 355/208-209, 246, 228, 229, 214, 69

[56] References Cited

U.S. PATENT DOCUMENTS

| | | | |
|---|---|---|---|
| 4,640,603 | 2/1987 | Honma | 355/69 X |
| 4,714,945 | 12/1987 | Fujiwara et al. | 355/69 |
| 4,737,821 | 4/1988 | Suzuki et al. | 355/326 |
| 4,743,946 | 5/1988 | Nishimori et al. | 355/214 |
| 4,745,489 | 5/1988 | Kashiwagi et al. | 355/214 X |
| 4,755,852 | 7/1988 | Fujita | 355/214 X |
| 4,796,060 | 1/1989 | Mizude | 355/69 X |
| 4,821,068 | 4/1989 | Honma et al. | 355/209 |
| 4,970,556 | 11/1990 | Iwata | 355/214 |
| 5,065,184 | 11/1991 | Iimori et al. | 355/208 |
| 5,075,725 | 12/1991 | Rushing et al. | 355/208 |
| 5,077,581 | 12/1991 | Suzuki et al. | 355/209 |

FOREIGN PATENT DOCUMENTS

| | | | |
|---|---|---|---|
| 0285105 | 10/1988 | European Pat. Off. | 355/214 |
| 2839076 | 3/1979 | Fed. Rep. of Germany | 355/214 |
| 0295547 | 12/1986 | Japan | 355/214 |
| 0043639 | 2/1987 | Japan | 355/214 |

*Primary Examiner*—Matthew S. Smith
*Attorney, Agent, or Firm*—Limbach & Limbach

[57] ABSTRACT

An image forming apparatus includes a detector for detecting a density of an image on an original document and a memory for storing a reference image forming condition for forming an image. The reference image forming condition is changable by an operator. An image forming condition corresponding to the density of the image on the original document and the reference image forming condition is generated. An image is formed in accordance with the image on the original document under the image forming condition.

3 Claims, 6 Drawing Sheets

IMAGE FORMING APPARATUS

BACKGROUND OF THE INVENTION

1. Field of the Invention

The present invention relates to an image forming apparatus, such as a copying apparatus, provided with an automatic exposure mode which exposes using quantity of the light appropriate to the density of the original document, and a manual exposure mode which exposes by a specified quantity of the light which takes a certain set value as a reference despite the density of the original document.

2. Description of the Related Art

An image forming apparatus, such as a copying apparatus, in which a manual exposure mode and an automatic exposure mode are provided is known. The manual exposure mode executes adjustment of exposure by operator's manual operation. The automatic exposure mode automatically executes adjustment for optimum exposure according to the density of the original document.

In this type of the image forming apparatus, generally, copying by the automatic exposure mode is sufficient. Also, the operator performs copying by adjustment of the exposure to the darker or lighter side, according to the original document being copied.

When copying using the automatic exposure mode in this way, depending on the original document being copied, it is sometimes made too dark or too light. Therefore, in such cases, operator's adjustment is required using the manual exposure mode.

However, when original documents which require exposure adjustment are a frequent occurrence, the operator has to make adjustments every time, and operation becomes very troublesome because of this.

As described above, in prior art, in a case where the operator often use the original document which is darker or lighter than a regular original document, the operator had to make exposure adjustments each time, depending on the original document being copied. Therefore, there was the drawback that operation for adjustment became very troublesome when there were many such original documents.

SUMMARY OF THE INVENTION

It is an object of the present invention to provide an image forming apparatus capable of exposure with accurate brightness even by automatic exposure as it stands, without re-adjustment of the manual exposure settings, thus reducing the time and labor required for setting and improving operability.

According to the present invention there is provided an image forming apparatus comprising means for detecting a density of an image on an original document; means for storing a reference image forming condition for forming an image; means for, operator-preferably, changing the reference image forming condition; means for generating an image forming condition corresponding to the density of the image on the original document and the reference image forming condition; and means for forming an image in accordance with the image on the original document under the image forming condition generated by the generating means.

DETAILED DESCRIPTION OF THE PREFERRED EMBODIMENT

Referring to the acompanying drawings, a detailed description will subsequently be given of the preferred embodiment of the present invention.

Figure 1:
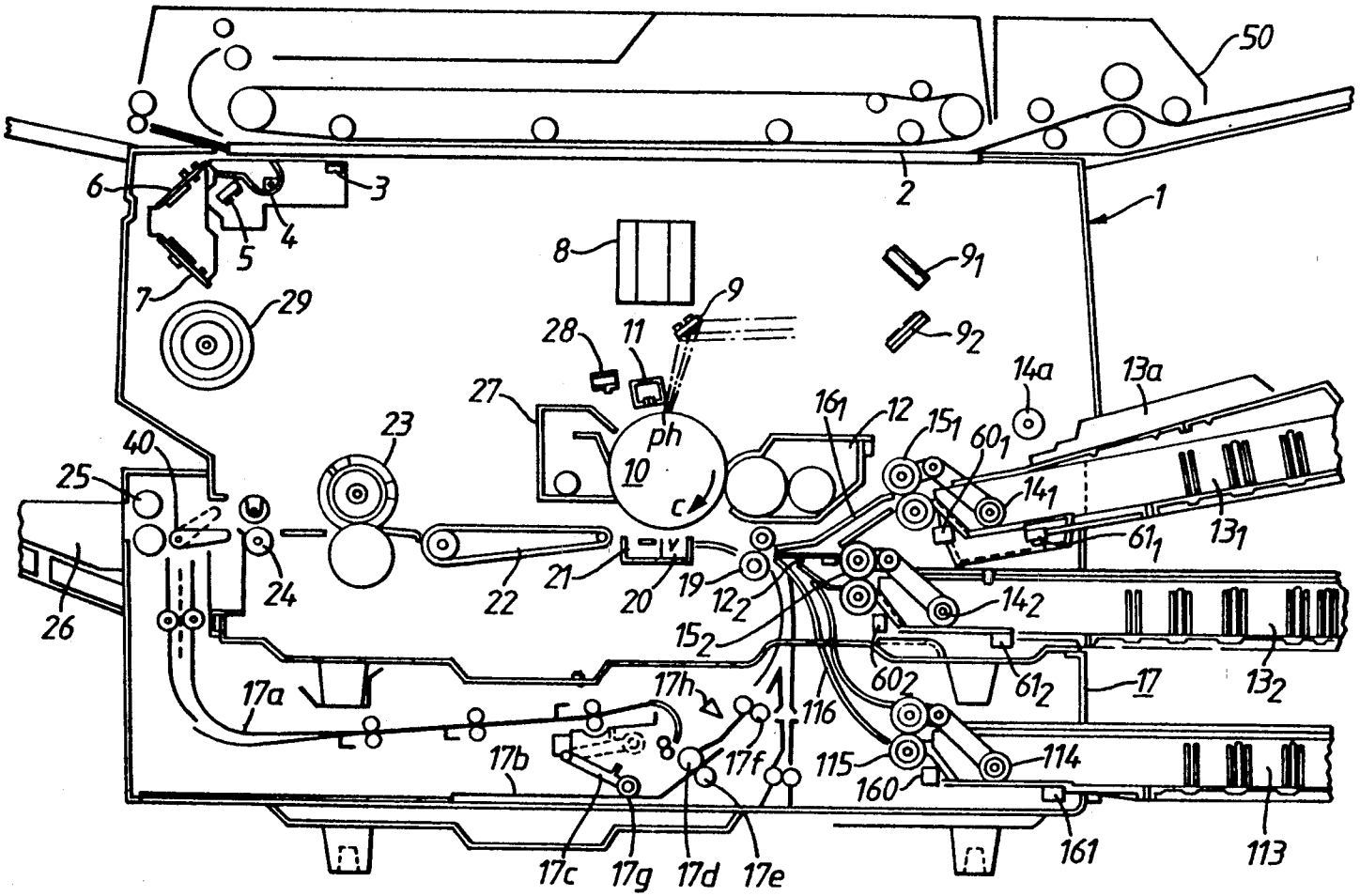
FIG. 1 is a sectional view showing an image forming apparatus of the present invention.

FIG. 1 is a sectional view showing an image forming apparatus according to the present invention.

Original document table (transparent glass) 2 which receives the original document is provided on the top face of main body 1. Automatic document feeder 50, which automatically transports the original document to the placement position, is provided on top of original document table 2 to continuously feed a plurality of original documents one by one. Since automatic document feeder 50 is free to open and close over original document table 2, original documents can also be manually set on original document table 2, one by one.

An original document placed on original document table 2 is exposure scanned by the reciprocal movement of an optical unit along the lower face of original document table 2. The optical unit comprises exposure lamp 4 and mirrors 5, 6 and 7. In this case, mirrors 6 and 7 are moved at ½ the speed of mirror 5, so that the optical path length can be maintained.

During automatic exposure (explained below), the density of the original document placed on original document table 2 is detected by exposure detector 3 provided in the vicinity of exposure lamp 4. Exposure detector 3 is arranged near the original document surface outside the optical path so as to receive light irregularly reflected by the original document surface.

The reflected light from the original document due to light irradiation by exposure lamp 4, is reflected by mirrors 5, 6 and 7. After this, the light passes through lens block 8 and is conducted to photosensitive drum 10, as an image bearing member, by being further reflected by mirrors 91, 92 and 93, so that an image of the original document can be formed on the surface of photosensitive drum 10.

Photosensitive drum 10 is rotated in the direction of arrow c, and its surface is first charged by main charger 11. After this, an electrostatic latent image is formed on photosensitive drum 10 by slit exposure at an exposure position Ph. This electrostatic latent image is developed to be visible by toner supplied from developing unit 12. Developing unit 12 is detachably arranged on main body 1.

Paper sheets as recording material are picked up one by one from the selected upper paper supply cassette $\mathbf{13}_1$, lower paper supply cassette $\mathbf{13}_2$ or additional paper supply cassette 113 by paper supply rollers $\mathbf{14}_1$, $\mathbf{14}_2$ or 114 and roller pairs $15_1$, $15_2$ or 115. Each of the paper sheets picked up is guided to aligning roller pair 19 through paper guide path $16_1$, $16_2$ or 116, and is fed to a transfer section by aligning roller pair 19.

Paper supply cassettes $13_1$ and $13_2$ are detachably arranged on the right lower end portion of main body 1. Additional paper supply cassette 113 is also detachably arranged on the right-hand side of paper supply unit 17, which is an automatic double-side unit (ADD) provided as an option for main body 1. Any one of paper supply cassettes $13_1$, $13_2$ or 113 can be selected on an operation panel described below.

The size of the paper sheets stored in each paper supply cassette $13_1$, $13_2$ and 113 is detected by respective cassette size sensors $60_1$, $60_2$ and 160. Cassette size sensors $60_1$, $60_2$ and 160 are composed of a number of microswitches which switch ON and OFF in response to the insertion of different size of cassettes.

The paper sheet storage state of each paper supply cassette $13_1$, $13_2$ and 113 is sensed by respective empty sensors $61_1$, $61_2$ and 161. Empty sensors $61_1$, $61_2$ and 161 are composed of, for instance, reflection type optical sensors.

Manual paper supply guide 13*a* is provided above paper supply cassette $13_1$. A paper sheet manually inserted via manual paper supply guide 13*a* is conducted to roller pair $15_1$, by paper supply roller 14*a*. Then, the paper sheet is transported in the same way as the paper sheet supplied from paper supply cassette $13_1$.

The paper sheet conveyed to the transfer section is brought into tight contact with the surface of photosensitive drum 10 at a portion of transfer charger 20, so that a toner image on photosensitive drum 10 is transferred onto the paper sheet upon operation of transfer charger 20. The paper sheet with the toner image transferred onto the first surface is electrostatically peeled away from photosensitive drum 10 by the operation of separation charger 21, and is conveyed along conveyer belt 22 to fixing roller pair 23. The paper sheet is then fed into fixing roller pair 23 serving as a fixing unit arranged at the trailing end portion of conveyer belt 22. Then, the toner image is fixed by passing through this portion, and the paper sheet after fixing (in the normal mode) is dispensed on receiving tray 26 outside main body 1 by paper dispense roller pairs 24 and 25.

Any remaining toner after transferring is removed from the surface of photosensitive drum 10 by cleaner 27, and a residual image on the surface of photosensitive drum 10 is erased by discharge lamp 28, thus returning photosensitive drum 10 to its initial state. Note that reference numeral 29 denotes a cooling fan for preventing the temperature in main body 1 from increasing.

Switching gate 40, which distributes the paper sheet after fixing to receiving tray 26 or into paper supply unit 17, is arranged between dispense roller pairs 24 and 25. The paper sheet distributed into paper supply unit 17 by switching gate 40 (the both sides (ADD) mode) is conveyed to the transfer section again, with its front and back reversed. By this means, an image is formed on the second side of the paper sheet and thus, finally, both sides' copying is executed on the two sides of one sheet of paper.

This paper sheet with images formed on both sides is dispensed onto receiving tray 26 outside main body 1 by paper dispense roller pairs 24 and 25 after the transferred image has been fixed by fixing roller pair 23, as described above.

Paper supply unit 17 comprises conveying path 17*a*, paper storage 17*b*, pick-up roller 17*c*, paper supply roller 17*d*, separation roller 17*e*, and aligning roller 17*f*. Conveying path 17*a* receives a paper sheet when required after fixing and conducts the paper sheet to the transfer section of main body 1 in a state in which its sides are reversed for executing both-side copying on this paper sheet. Paper storage 17*b* temporarily stacks the paper sheets conveyed by conveying path 17*a*. Pick-up roller 17*c* is swingably provided to pick up paper sheet stacked in paper storage 17*b*. Paper supply roller 17*d* feeds the paper sheet picked up by pick-up roller 17*c* to the transfer section of main body 1.

Empty switch 17*g*, which detects the presence or absence of paper sheet in paper storage 17*b*, and paper stop switch 17*h*, which checks the presence or absence of paper sheet at the position of aligning roller 17*f*, are provided in paper supply unit 17. Empty switch 17*g* is composed of, for instance, a reflector type optical detector.

Figure 2:
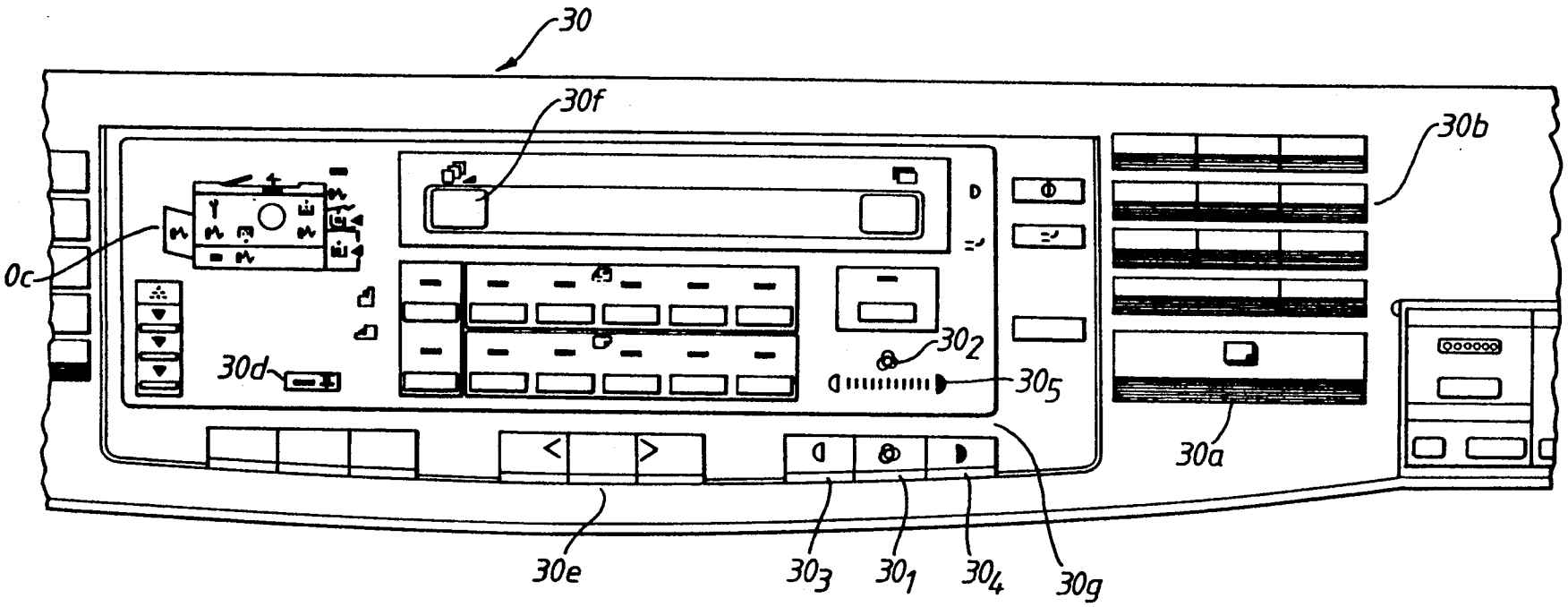
FIG. 2 is a plan view showing an operation panel of the image forming apparatus shown in FIG. 1.

FIG. 2 shows an essential part of operation panel 30 mounted on main body 1. Reference numeral 30*a* denotes a print key for instructing start of a copying operation; 30*b*, digital keys for setting of the number of copies and the like; 30*c*, a state display for displaying operating states of respective sections, paper jams, and the like; 30*d*, a cassette selection key for selecting upper, lower or additional paper supply cassette $13_1$, $13_2$ or 113; 30*e*, zoom keys comprising an equal-magnification key operated when a copying magnification is set at an equal magnification (100%), a reduction key operated when a copying magnification is set at a reduced magnification and an enlargment key operated when a copying magnification is set at an enlarged magnification; 30*f*, a magnification ratio indicator for displaying the set magnification ratio; and 30*g*, a density setting section as an image forming condition for setting a copying density.

Density setting section 30*g*, which is used for setting the image forming condition, is composed of automatic exposure key $30_1$, automatic exposure indicator $30_2$, manual light key $30_3$, manual dark key $30_4$ and manual exposure indicator $30_5$.

Figure 3:
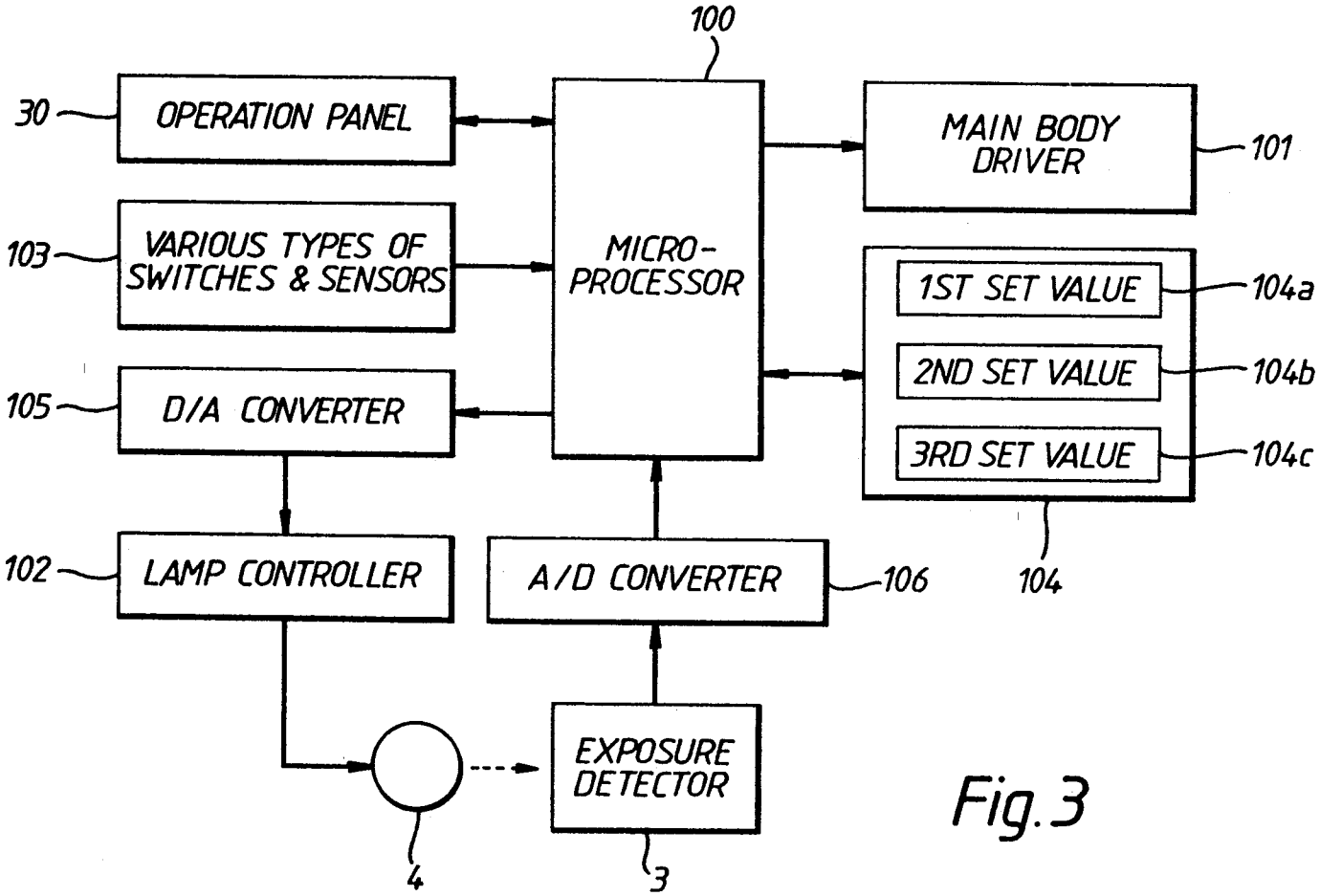
FIG. 3 is a block diagram of a control system of the image forming apparatus.

FIG. 3 shows the overall control circuit. Microprocessor 100 controls the overall operation of the image forming apparatus. That is, microprocessor 100 controls main body driver 101 to execute the image forming operation described above and controls lamp controller 102 to execute exposure control of exposure lamp 4.

Operation panel 30, various types of sensors 103, such as cassette size sensors $60_1$, $60_2$ and 160 and empty sensors $61_1$, $61_2$ and 161, exposure detector 3 and memory 104 are connected to microprocessor 100.

Microprocessor 100 computes a voltage, which will be supplied to exposure lamp 4, on referring to a content of memory 104, a detection result of exposure detector 3 and a setting of manual light key $30_3$ and manual dark key $30_4$ and generates a signal for exposure controlling. Microprocessor 100 outputs the signal for exposure controlling to lamp controller 102 through D/A converter 105. Lamp controller 102 supplies a voltage in accordance with the signal for exposure controlling. Exposure detector 3 detects a quantity of the light, which is generated by exposure lamp 4 to illuminate the original document, reflected by the original document. Then, exposure detector 3 outputs the detection result to microprocessor 100 through A/D converter 106. If the quantity of the reflected light detected by exposure detector 3 is smaller than the prescribed value, exposure detector 3 outputs a low voltage. While, if the quantity of the reflected light detected by exposure detector 3 is larger than the prescribed value, exposure detector 3 outputs a high voltage. A/D converter 106 converts the output, which is analog value, from exposure detector 3 into digital value and outputs the digital value to microprocessor 100. While D/A converter 105 converts the output, which is digital value, from microprocessor 100 into analog value and outputs the analog value to lamp controller 102.

Memory 104 comprises first area 104*a* for storing a first set value, which is used for determining the quantity of the light during automatic exposure, second area 104*b* for storing a second set values, which are used for determining the quantity of the light during manual exposure, and third area 104*c* for storing a third set value, which is used in adjusting the exposure during automatic exposure.

A center value (reference value) corresponding to the medium density of manual exposure, a light value ('Light MAX') corresponding to the brightest (light) density of manual exposure and a dark value ('Dark MAX') corresponding to the darkest (dark) density of manual exposure are stored in second area 104*b* of memory 104 as the second set values which are used for determining the quantity of the light during manual exposure. The values corresponding to other densities can be found by calculation.

In the case of this embodiment, 13 steps can be set for manual exposure. The exposure adjustment can be performed in 6 steps on each of the light side and the dark side with the medium density (the center value is taken as step 0) as the center. Therefore, for the light side, the values corresponding to each density from step 1 to step 5 are found by each of the steps when the values between the center value and the light value are divided into 6 equal parts. Similarly, for the dark side, the values corresponding to each density from step 1 to step 5 are found by each of the steps when the values between the center value and the dark value are divided into 6 equal parts.

Next, the operation of the above construction will now be described.

Figure 4:
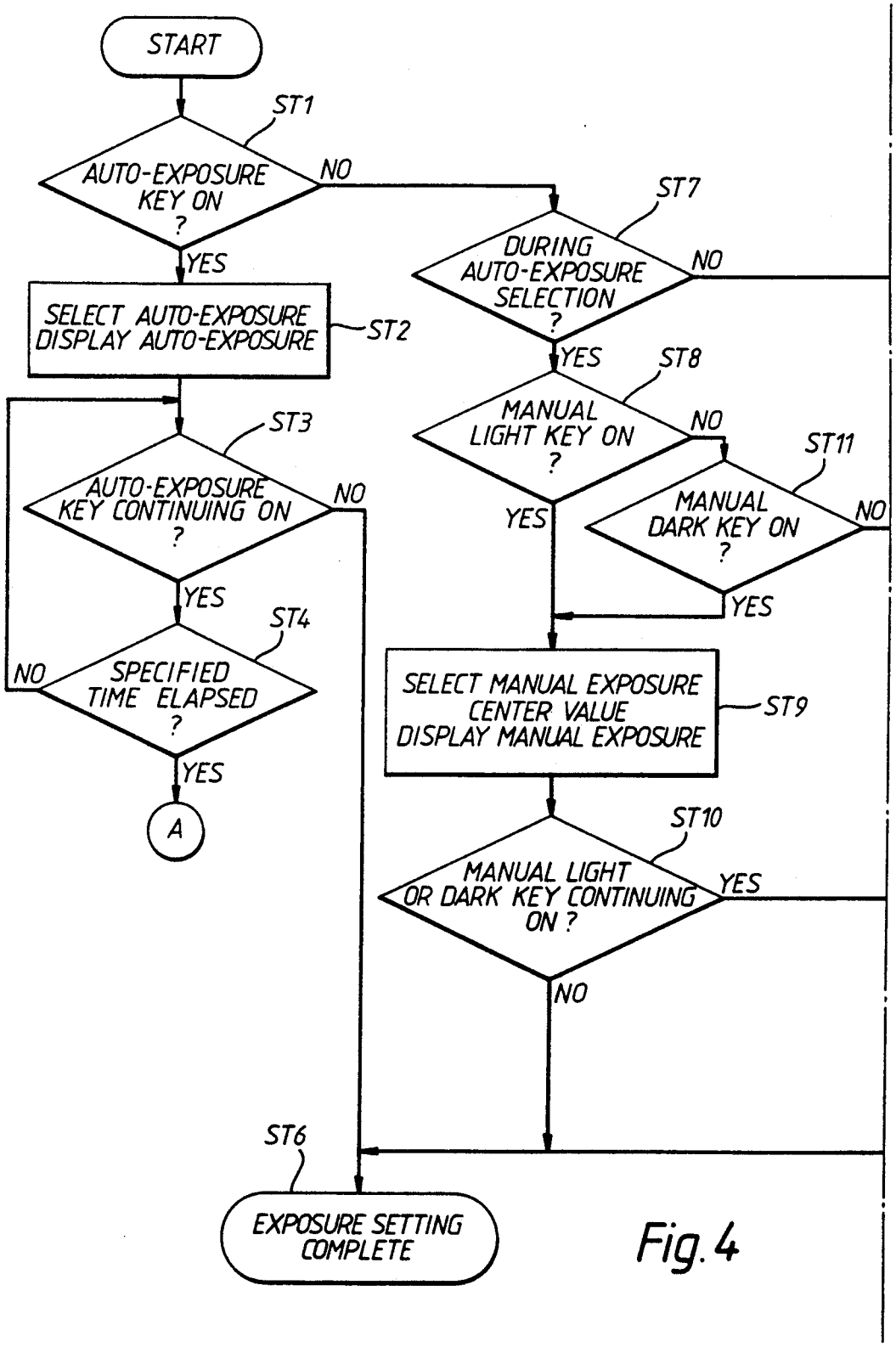
FIG. 4 is a flow-chart showing the sequence of processes relating to the exposure setting operation of the image forming apparatus according to the present invention.
Figure 4:
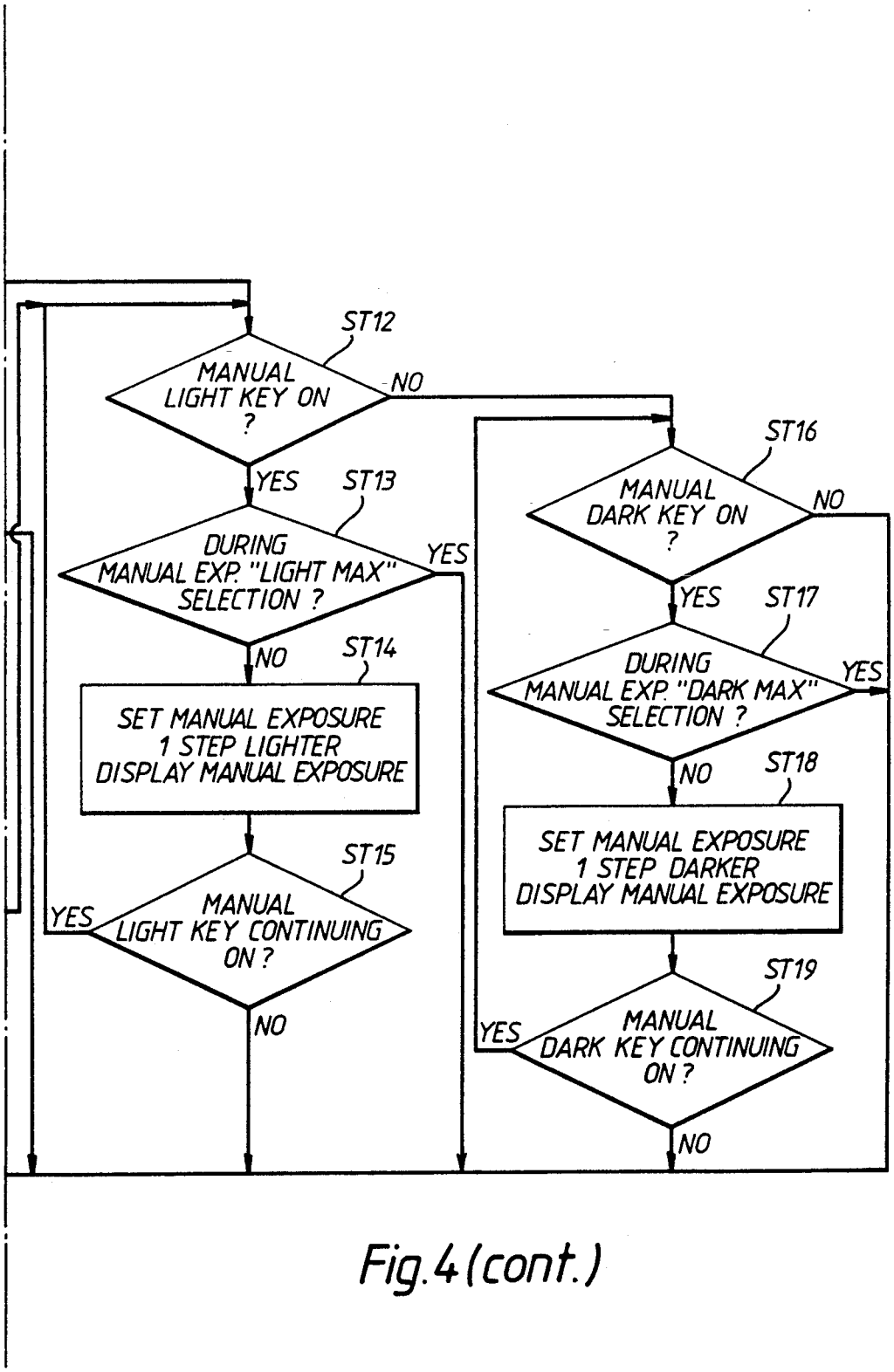

FIG. 4 shows a flow-chart concerned in the exposure setting operation. For instance, here, it is assumed that automatic exposure key $30_1$, in density setting section 30*g* on operation panel 30 is in operation (ST1: YES). Then, the automatic exposure mode is forcibly selected, and automatic exposure indicator $30_2$ is switched ON (ST2). In this state, when the input of automatic exposure key $30_1$ is not judged to be continuous, the exposure setting operation is completed (ST3: NO and ST6).

During automatic exposure, the output in response to light irregularly reflected from the original document detecting by exposure detector 3, together with the input of print key 30*a*, is transmitted by the A/D converter 106 to microprocessor 100. The output value of exposure detector 3, after A/D conversion, is compared with the adjusted value which is calculated based on the first set value stored in first area 104*a* of memory 104, taking account of copy magnification. By controlling lamp controller 102 according to the result of this comparison, exposure lamp 4 is switched on with a quantity of the light corresponding to the density of the original document. Thus, scanning of the original document can be executed.

In case of the automatic exposure, exposure detector 3 detects a quantity of the light reflected by the original document, which is changed in accordance with the density of the original document, and generates a detection value corresponding to the detection result. Microprocessor 100 controls lamp controller 102 such that the detection value corresponds to the first set value (reference value of a quantity of the light) stored in the first area 104*a* of memory 104. That is, lamp controller 102 supplies a high voltage to exposure lamp 4 when the density of the original document was higher than the prescribed value. When the density of the original document was lower than the prescribed value, lamp controller 102 supplies a low voltage to exposure lamp 4.

It is assumed that, during the selection of automatic exposure (ST7: YES), manual light key $30_3$ or manual dark key $30_4$ have been operated only once (ST8: YES). Then, automatic exposure indicator $30_2$ is switched off. At the same time in this case, the center value during manual exposure is selected, and the center lamp of manual exposure indicator $30_5$ is switched on (ST9). In this state, when the input of manual light key $30_3$ or manual dark key $30_4$ is not judged to be continuous, the exposure setting operation is completed (ST10: NO and ST6).

When there is judged to be no input of manual light key $30_3$ or manual dark key $30_4$, the exposure setting operation is completed (ST8: NO, ST11: NO and ST6).

During manual exposure, together with the operation of print key 30*a*, lamp controller 102 is controlled in response to the center value of the second set values which is read from second area 104*b* of memory 104 by microprocessor 100. By this means, exposure lamp 4 is switched on with a quantity of the light corresponding to medium density, and scanning of the original document can be executed.

It is further assumed that, during the selection of manual exposure, manual light key $30_3$ is operated (ST12: YES). In this case, the exposure setting operation is completed when the lightest density ('Light MAX') has already been selected by manual light key $30_3$, in other words when the left end lamp of manual exposure indicator $30_5$, is switched on by the selection of the 'Light' value during manual exposure (ST13: YES and ST6).

During manual exposure, together with the operation of print key 30*a*, lamp controller 102 is controlled in response to the 'Light' value of the second set values which is read from second area 1046 of memory 104 by microprocessor 100. By this means, exposure lamp 4 is switched on with a quantity of the light corresponding to the lightest density, and scanning of the original document can be executed.

When the lightest density is not selected, the setting becomes one step lighter, and the switching on of the lamps of manual exposure indicator $30_5$ is shifted one lamp to the light (left) side. Thus, by the operation of manual light key $30_3$, a lighter density is selected at one step and, at the same time, the display is shifted at one step (ST14). The operation of manual light key $30_3$ is judged to be continuous or not (ST15). When the operation of manual light key $30_3$ is judged to be continuous, the prosecutions between ST12 and ST14 are repeated. By this repetition, a lighter density is gradually selected step by step and, at the same time, the display of manual exposure indicator $30_5$ is shifted continuously.

During manual exposure, together with the operation of print key 30*a*, lamp controller 102 is controlled in response to a value corresponding to a set value found from the center value and the 'Light' value of the second set values which are read from second area 104*a* of memory 104 by microprocessor 100. By this means, exposure lamp 4 is switched on with a quantity of the light corresponding to the set density, and scanning of the original document can be executed.

In the same way, it is further assumed that, during the selection of manual exposure, manual dark key $30_4$ is operated (ST16: YES). In this case, the exposure setting operation is completed when the darkest density ('Dark MAX') has already been selected by manual dark key $30_4$, in other words when the right end lamp of manual exposure indicator $30_5$ is switched on by the selection of the 'Dark' value during manual exposure (ST17: YES and ST6).

During manual exposure, together with the operation of print key 30*a*, lamp controller 102 is controlled in response to the 'Dark' value of the second set values which is read from second area 104*b* of memory 104 by microprocessor 100. By this means, exposure lamp 4 is switched on with a quantity of the light corresponding to the darkest density, and scanning of the original document can be executed.

On the other hand, when the darkest density is not selected, the setting becomes one step darker, and the switching on of the lamps of manual exposure indicator $30_5$ is shifted one lamp to the dark (right) side. Thus, by the operation of manual dark key $30_4$, a darker density is selected at one step and, at the same time, the display is shifted at one step (ST18). The operation of manual dark key $30_4$ is judged to be continuous or not (ST19). When the operation of manual dark key $30_4$ is judged to be continuous, the prosecutions between ST16 and ST18 are repeated. By this repetition, a darker density is gradually selected step by step and, at the same time, the display of manual exposure indicator $30_5$ is shifted continuously.

During manual exposure, together with the operation of print key 30*a*, lamp controller 102 is controlled in response to a value corresponding to a set value found from the center value and the 'Dark' value of the second set values which are read from second area 104*b* of memory 104 by microprocessor 100. By this means, exposure lamp 4 is switched on with a quantity of the light corresponding to the set density, and scanning of the original document can be executed.

In the state in which automatic exposure mode setting has been executed by the operation of automatic exposure key $30_1$ (ST2), it is further assumed that automatic exposure key $30_1$ is operated (ST3) and continues to be operated for more than a specified time, for instance, more than 1 second (ST4: YES). In this case, the set value during automatic exposure can be varied in accordance with the value which has been set in the immediately preceding manual exposure.

Figure 5:
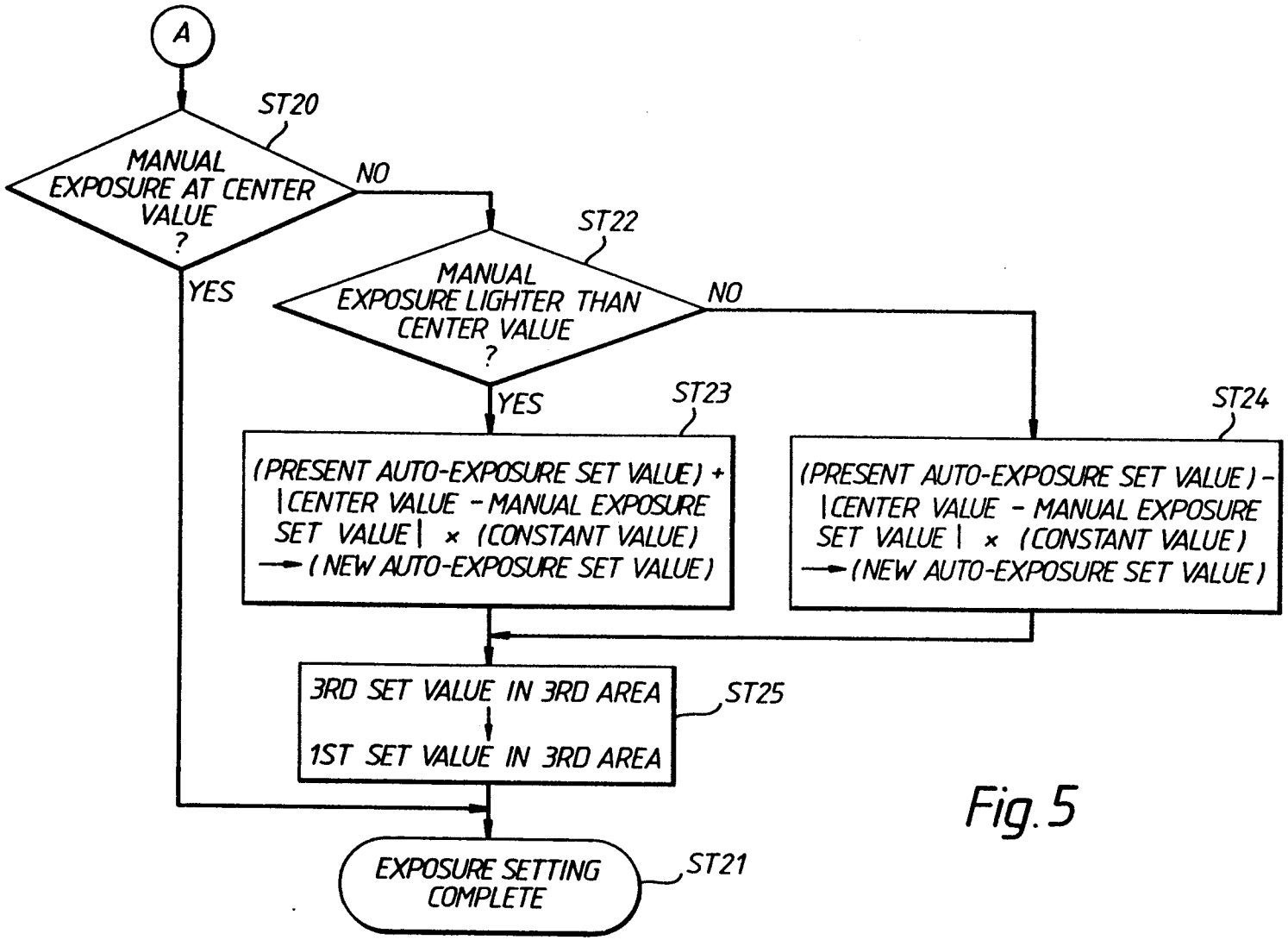
FIG. 5 is a flow-chart showing the sequence of processes relating to the alteration operation for the set value during automatic exposure of the image forming apparatus according to the present invention.

FIG. 5 shows a flow-chart concerned in the alteration of the set value during automatic exposure. In the state in which manual exposure has been selected, when automatic exposure key $30_1$ is continuously operated for more than 1 second, first, the set value corresponding to the setting during manual exposure is discriminated. When the setting at this time is the medium density of manual exposure, in other words the center value (ST20: YES), the setting operation for exposure is completed (ST21). During this automatic exposure, lamp controller 102 is controlled in response to the result of comparison of the A/D value of the output of exposure detector 3 and the adjustment value calculated based on the first set value stored in first area 104*a* of memory 104, taking account of copy magnification. By this means, exposure lamp 4 is switched on with a quantity of the light corresponding to the density of the original document. Thus, scanning of the original document can be executed.

When the setting is not the medium density of manual exposure, in other words off-center value (ST20: NO), the flow is advanced to ST22. When the setting during manual exposure was selected at a lighter density than medium density (ST22: YES), in other words when a several steps' lighter value than the center value has been set on the 'Light MAX' side, the first set value during automatic exposure is altered so that it becomes lighter by a quantity of variation equivalent to that number of steps. For instance, when a one-step lighter value has been selected on the 'Light MAX' side, the first set value during automatic exposure is caused to slip in the lighter direction corresponding to a slippage of one step from the center value (ST23). Then the third set value in third area 104*c* is altered to the first set value (ST25).

Conversely, when the setting during manual exposure was selected at a darker density than medium density (ST22: NO), in other words when a several steps' darker value than the center value has been set on the 'Dark MAX' side, the first set value during automatic exposure is altered so that it becomes darker by a quantity of variation equivalent to that number of steps. For instance, when a two-steps' darker value has been selected on the 'Dark MAX' side, the first set value during automatic exposure is caused to slip in the darker direction corresponding to a slippage of two steps from the center value (ST24). Then the third set value in third area 104*c* is altered to the first set value (ST25).

By this means, during the following automatic exposure, lamp controller 102 is controlled based on a new set value (the third set value in third area 104*c*) altered according to the setting during manual exposure. As a result, exposure lamp 4 is switched on with a quantity of the light corresponding to the density of the setting during manual exposure, and scanning of the original document can be executed. Therefore, the operator can copy with the required lightness (or darkness) without having to execute the exposure adjustment for manual exposure every time.

When the operator usually wants to obtain a copy which is slightly lighter than a standard density copy, it is not necessary to set a quantity of light of the exposure lamp 4 one by one copy when the manual exposure mode since the operator can adjust a quantity of the light of the exposure lamp 4 as a reference value in the automatic exposure mode.

When returning the set value to the original, for instance in the state in which the center value was selected during manual exposure, this can be carried out by continuously operating automatic exposure key $30_1$, for more than one second.

As described above, the exposure during automatic exposure can be adjusted according to the setting during manual exposure. That is, the set value used for determining the quantity of the light during automatic exposure can be altered according to the setting during manual exposure. By this means, exposure by automatic exposure using the same quantity of the light as frequently-used manual exposure settings becomes possible without having to execute every time the exposure adjustment during manual exposure. Consequently, the time and labor required for the setting of manual exposure can be reduced and therefore improvement of operability can be designed.

Also, the changing of the set value during automatic exposure can be judged by the operating time of the automatic exposure key. Therefore, there is no requirement for any specific device, and cost increase is avoided.

In the embodiment described above, the case in which changing of the set value during automatic exposure is judged from the operating time of the automatic exposure key is described. However, the present invention is not limited to this, and, for instance, a dedicated key may be provided separately. Also, changing of the set value may be executed by operating the manual light key or the manual dark key while pressing the automatic exposure key.

Further, in the above embodiment, the density setting section comprising the automatic exposure key, the automatic exposure indicator, the manual light key, the manual dark key and the manual exposure indicator is described as the setting means of the image forming condition. That is, the image forming condition is changed by the changing of a quantity of the light of the exposure lamp. However, the present invention is not limited to this, and, for instance, changing the image forming condition may be executed by controlling or changing a bias voltage applying to the developing device, or an amount of charge by the main charger for the photosensitive drum.

According to the present invention, an image forming apparatus can be provided which is capable of exposure with the correct brightness, even with automatic exposure itself, without re-adjusting the manual exposure setting, and is capable of reducing the time and labor required for settings, thus being capable of increasing operability.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. An image forming apparatus comprising:

means for detecting a density of an image on an original document;

means for storing a first image forming condition as a reference image forming condition:

means for manually setting a second image forming condition;

first generating means for generating a third image forming condition corresponding to the density of the image on the original document and the reference image forming condition;

means for changing the first image forming condition stored in the storing means to the second image forming condition set by the manual setting means;

means for forming an image in accordance with the image on the original document under a predetermined image forming condition;

first setting means for setting an automatic image forming mode;

second setting means for setting a manual image forming mode;

means for controlling the image forming means to form an image in accordance with the image on the original document under the third image forming condition when the automatic image forming mode is set by the first setting means, and controlling the image forming means to form an image in accordance with the image on the original document under the second image forming condition when the dual image forming mode is set by the second setting means;

second generating means for generating a signal when the first setting means is operated for longer than a specified time; and means for causing the changing means to change the reference image forming condition to the second image forming condition in response to the signal generated by the second generating means.

2. An image forming apparatus comprising:

means for exposing an image on an original document with a light;

means for detecting a quantity of the light reflected by the original document and generating a detection value corresponding to the quantity of the light;

means for storing a first value corresponding to a reference quantity of light as a reference value;

means for computing a second value, representing a quantity of light, based on the detection value and the reference value;

means for manually setting a value corresponding to a desirable quantity of light;

means for changing the first value stored in the storing means to the setting value set by the manually setting means;

first setting means for getting an automatic exposing mode, such that the exposing means exposes the original document with a quantity of the light appropriate to the density of the image on the original document;

second setting means for setting a manual exposing mode, such that the exposing means exposes the original document with a predetermined quantity of the light despite the density of the image on the original document;

means for controlling the exposing means, to expose the original document with the quantity of light corresponding to the second value computed by the computing means when the first setting mode is operated, and controlling the exposing means to expose the original document with the quantity of light corresponding to the setting value set by the manually setting means when the second setting mode is operated;

means for generating a signal when the first setting means is operated for longer than a specified time; and means for causing the changing means to change the first value to the setting value in response' to the signal generated by the generating means.

3. An image forming apparatus comprising:

means for exposing an image on an original document with a light;

first setting means for setting an automatic exposing mode such that the exposing means exposes the original document with a quantity of light appropriate to the density of the image on the original document;

second setting means for setting a manual exposing mode such that the exposing means exposes the original document with a predetermined quantity of light despite the density of the image on an original document;

image density detecting means for detecting a quantity of light reflected by the original document and generating a detection value corresponding to the quantity of the light during a current exposing operation of the exposing means;

means for storing a first value corresponding to a reference quantity of light as a reference value;

means for computing a second value, representing a quantity of light, based on the detection value generated by the image density detecting means and the reference value stored in the storing means during the current exposing operation of the exposing means when the automatic exposing mode is set by the first setting means;

means for manually setting a third value, representing a quantity of light for the exposing operation when the manual exposing mode is set by the second setting means;

means for controlling the exposing means to expose the original document with the quantity of light corresponding to the second value computed by the computing means during the current exposing operation when the automatic exposing mode is set by the first setting means, and for controlling the exposing means to expose the original document with the quantity of light corresponding to the third value set by the manually setting means when the manual exposing means is set by the second setting means; and means for changing the first value stored in the storing means to the third value set by the manually setting means.

* * * * *